US007028437B2

(12) United States Patent
Hauck

(10) Patent No.: US 7,028,437 B2
(45) Date of Patent: Apr. 18, 2006

(54) ABOVE-JOIST, INTEGRATED DECK-GUTTER SYSTEM

(76) Inventor: Robert F. Hauck, 13555 Depot St. #E, San Martin, CA (US) 95046

( * ) Notice: Subject to any disclaimer, the term of this patent is extended or adjusted under 35 U.S.C. 154(b) by 22 days.

(21) Appl. No.: 10/346,892

(22) Filed: Jan. 17, 2003

(65) Prior Publication Data

US 2004/0020136 A1 Feb. 5, 2004

Related U.S. Application Data

(60) Provisional application No. 60/399,681, filed on Jul. 31, 2002.

(51) Int. Cl.
*E04B 1/70* (2006.01)

(52) U.S. Cl. ..... 52/302.1; 52/302.3; 52/11

(58) Field of Classification Search ..... 52/11, 52/12, 302.1, 302.3, 483.1, 489.1, 586.1, 52/586.2, 585.1, 650.3, 510, 513; 403/298, 403/294, 387

See application file for complete search history.

(56) References Cited

U.S. PATENT DOCUMENTS 1,946,646 A * 2/1934 Storm ..... 52/586.1
4,065,883 A 1/1978 Thibodeau
4,599,841 A * 7/1986 Haid ..... 52/586.2
4,860,502 A 8/1989 Mickelsen
5,511,351 A 4/1996 Moore
5,557,903 A * 9/1996 Haddock ..... 52/508
5,649,399 A * 7/1997 Kepets ..... 52/396.06
5,660,016 A * 8/1997 Erwin et al. ..... 52/483.1
5,694,730 A * 12/1997 Del Rincon et al. ..... 52/586.1
5,758,467 A 6/1998 Snear et al.
5,765,328 A 6/1998 Moore
5,775,048 A * 7/1998 Orchard ..... 52/712
5,819,491 A * 10/1998 Davis ..... 52/592.1
6,202,377 B1 * 3/2001 Krieger ..... 52/586.1
6,212,837 B1 4/2001 Davis et al.
6,226,956 B1 5/2001 Davis et al.
6,260,316 B1 7/2001 Davis et al.
6,279,271 B1 8/2001 Burkart, Jr.
6,308,479 B1 10/2001 Prohofsky
6,314,699 B1 * 11/2001 West ..... 52/489.1
6,336,300 B1 * 1/2002 Babucke ..... 52/396.04
6,393,785 B1 5/2002 Burt
6,415,571 B1 7/2002 Risser
6,484,467 B1 * 11/2002 Crout ..... 52/483.1
6,637,163 B1 * 10/2003 Thibault et al. ..... 52/177
6,698,148 B1 * 3/2004 Manna et al. ..... 52/302.1

(Continued)

FOREIGN PATENT DOCUMENTS

JP 05125802 A * 5/1993

*Primary Examiner*—Peter M. Cuomo
*Assistant Examiner*—Stephen D'Adamo
(74) *Attorney, Agent, or Firm*—Donald E. Schreiber

(57) ABSTRACT

A deck with an integrated gutter system includes at least two separated joists and a plurality of planks. Each plank includes longitudinal grooves, is disposed above and supported by the joists, has an undersurface which is juxtaposed with the joists, and is secured to the joists. The deck also includes a plurality of unitary channels. Each channel includes a pair of flanges which mate with longitudinal grooves of immediately adjacent planks. The mating of the flanges of the channel with the grooves of the planks provides the deck with an impervious gutter that extends between and along the two planks, and is located above the joists to which the planks are secured.

7 Claims, 4 Drawing Sheets

U.S. PATENT DOCUMENTS 6,711,864 B1 * 3/2004 Erwin ..... 52/582.1
2002/0032990 A1 3/2002 Burkhart, Jr.
2002/0059766 A1 * 5/2002 Gregori ..... 52/489.1
2003/0111397 A1 * 6/2003 Stegmeier et al. ..... 210/164

* cited by examiner

ABOVE-JOIST, INTEGRATED DECK-GUTTER SYSTEM

CLAIM OF PROVISIONAL APPLICATION RIGHTS

This application claims the benefit of U.S. Provisional Patent Application No. 60/399,681 filed on Jul. 31, 2002

BACKGROUND OF THE INVENTION

1. Field of the Invention

The present invention relates generally to decks that may be attached to the exterior of buildings, and more particularly to a gutter system that is integrated directly into the deck's planks.

2. Description of the Prior Art

Published U.S. Patent Application No. 2002/0032990 A1 ("the '990 patent publication"), a continuation-in-part of U.S. Pat. No. 6,279,271 B1 ("the '271 patent"), discloses that typically, decks have planks for flooring with openings between the planks through which water and other matter infiltrate. Usually decks are attached to building structures. Many upper story decks have useable space beneath them, including lower decks and patios. It is often desirable to protect areas under decks from infiltration, particularly of rainwater, and to divert the infiltration away from areas beneath the deck.

Ways of dealing with infiltrations though decks include:

1. special decking planks having a trough formed along one edge and a mating flange formed along another edge;
2. building a flat or sloping roof at some level underneath the deck planks as part of the deck structure;
3. attaching water shedding gutters directly or indirectly to deck joists; and
4. attaching water channeling troughs to deck joists.

U.S. Pat. No. 5,758,467 ("the '467 patent") discloses a modular deck member or plank 30 preferably made from a material which has the requisite durability, strength, and flexibility characteristics necessary for the plank 30. The planks 30 are preferably extruded from polyvinyl chloride ("PVC"), or alternatively from any suitable thermoplastic material, such as polypropylene, polyethylene, low density polyethylene ("LDPE"), vinyl acetate copolymers, vinyl chloride monomers ("VCM"), or acrylonitrile-butadiene-styrene ("ABS").

The plank 30 disclosed in the '467 patent includes several hollow channels 510*a*–510*d* that extend parallel to each other throughout its length. A first connector portion 200, which is extruded along one edge of the plank 30, includes a U-shaped gutter 220 that has an upwardly projecting finger 270 which forms one edge of the plank 30. A second connector portion 300, extruded along the other edge of the plank 30, includes a groove 350. The groove 350 is adapted to receive the finger 270 of the first connector portion 200 of an immediately adjacent plank 30 between a groove strut 360 and a leg 430. The leg 430 extends downward from the top of one plank 30, parallel and adjacent to the finger 270, to a gutter floor 240 of the gutter 220 of an immediately adjacent plank 30. A foot member 440, that is located immediately above the gutter floor 240 and that projects away from the leg 430 across the gutter floor 240, forms the other edge of the plank 30. Thus, during assembly of a deck using planks 30 the leg 430 and foot member 440 of the second connector portion 300 of a first plank 30are inserted into the gutter 220 of a second plank 30 such that the finger 270 of the second plank 30 is disposed within the groove 350 of first plank 30, and foot member 440 is disposed in contact with gutter floor 240. In this way the second connector portion 300 of the first plank 30 overlaps into the gutter 220 of the first connector portion 200 of the second plank 30. Fasteners 40, which extend downward through holes that respectively pierce both the foot member 440 of one plank 30 and the gutter floor 240 of an immediately adjacent plank 30, fix the planks 30 to a subfloor or supporting structure. Assembled in this way, gutters 220 permit water to drain along their respective lengths between and parallel to pairs of immediately adjacent planks 30. However, the gutters 220 provided by the planks 30 are not impervious due to the presence of the holes through which pass the fasteners 40. Thus, runoff water may penetrate the gutter 220 to the subfloor or supporting structure immediately beneath planks 30.

Instead of planks manufactured specifically for use in decks, a flat roof may be built as part of the deck structure above joists which support the decking planks before planks forming the deck are laid onto the roof. As is readily apparent, such a flat roof must be built first during the deck's construction. Alternatively, a sloping roof with framing can be built beneath the joists supporting the deck. The '271 patent and the '990 patent publication respectively disclose a sloping roof that is located beneath deck planks and joists.

Instead of constructing a roof beneath the deck's planks, elongated drainage gutters can be attached directly or indirectly to joists that support the deck's planks. U.S. Pat. Nos. 4,860,502, 5,511,351, 5,765,328, 6,212,837 B1, 6,226,956 B1 and 6,393,785 B1 all disclose elongated drainage gutters which are fastened to sides of joists that support the deck's planks and span between the joists. U.S. Pat. Nos. 6,260,316 B1 and 6,415,571 B2 both disclose elongated drainage gutters which are supported beneath the joists that support the deck's planks and span between the joists. U.S. Pat. No. 4,065,883 ("the '883 patent") discloses gutters disposed between joists having flanges or lips that are fastened to the top of deck joists with the deck's planks being laid onto of the trough's flanges or lips. Finally, U.S. Pat. No. 6,308,479, in one embodiment, discloses elongated support rails, that are fastened directly to the lower surface of decking planks between joists, to which elongated drainage gutters are attached.

A major problem with all these trough-type drainage systems is that they depend on joist orientation and regularity of spacing between joists. Many decks are built with joists of one section oriented perpendicularly or diagonally to joists of other sections. Some decks have sections at different levels. The mechanics and appearance of integrating irregular and/or transversely oriented troughs, perhaps at different elevations, is awkward as best and probably unworkable in a great many situations.

Another major problem is achieving satisfactory appearance for these drainage systems. For appearance purposes, bottoms of decks with troughs in the joist area may preferably be covered, adding additional material and weight to the structure, and, making access for maintenance and leakage problems even more difficult. Infiltrations between the trough and the deck's structure is another problem that is generally not addressed in the references identified above. Presumably, at least for existing decks, a lot of caulking and flashing would be required in the joist space. If there is a maintenance problem with the gutter systems disclosed in the references, access could be very difficult.

From a structural perspective, other than for the gutter systems disclosed in the '467 and the '883 patents, the references identified above disclose gutter systems that effectively constitute separate roofs positioned somewhere below the upper surface of joists that support the deck's planks. Other than for the special purpose decking planks disclosed in the '467 patent, none of the gutter systems disclosed in those references are integrated directly into the deck's planks.

BRIEF SUMMARY OF THE INVENTION

An object of the present invention is to provide a gutter system which is easily incorporated into a deck.

Another object of the present invention is to provide a gutter system for a deck which is simple to construct.

Yet another object of the present invention is to provide a gutter system for a deck that is durable.

Yet another object of the present invention is to provide a gutter system for a deck that is cost effective.

Yet another object of the present invention is to provide a gutter system for a deck that is easily and economically manufactured.

Yet another object of the present invention is to provide a gutter system for a deck that is easily maintained.

Briefly, a deck which incorporates an integrated gutter system in accordance with the present invention includes at least two separated joists and a plurality of planks. Each plank includes longitudinal grooves, is disposed above and supported by the joists, has an undersurface which is juxtaposed with the joists, and is secured to the joists. The deck also includes a plurality of unitary channels. Each channel includes a pair of flanges which mate with the longitudinal grooves of immediately adjacent planks. The mating of the flanges of the channel with the grooves of the planks provides the deck with an impervious gutter that extends between and along the two planks, and is located above the joists to which the planks are secured.

A preferred embodiment of the present invention employs slices that are cut into undersurfaces of planks to provide grooves that receive flanges disposed along edges of channels with a central section of each channel resting on the joists. One alternative embodiment of the present invention employs slices that are cut into side surfaces of the planks to provide grooves that receive flanges that have ridges and that are disposed along edges of channels' central section. Yet another alternative embodiment of the present invention employs grooves which mate and lock with peaks of upward projecting flanges of the channels' central section.

An advantage of the present invention is that the gutter system is essentially invisible from above, and appears only as narrow strips from below.

These and other features, objects and advantages will be understood or apparent to those of ordinary skill in the art from the following detailed description of the preferred embodiment as illustrated in the various drawing figures.

DETAILED DESCRIPTION

Figure 1:
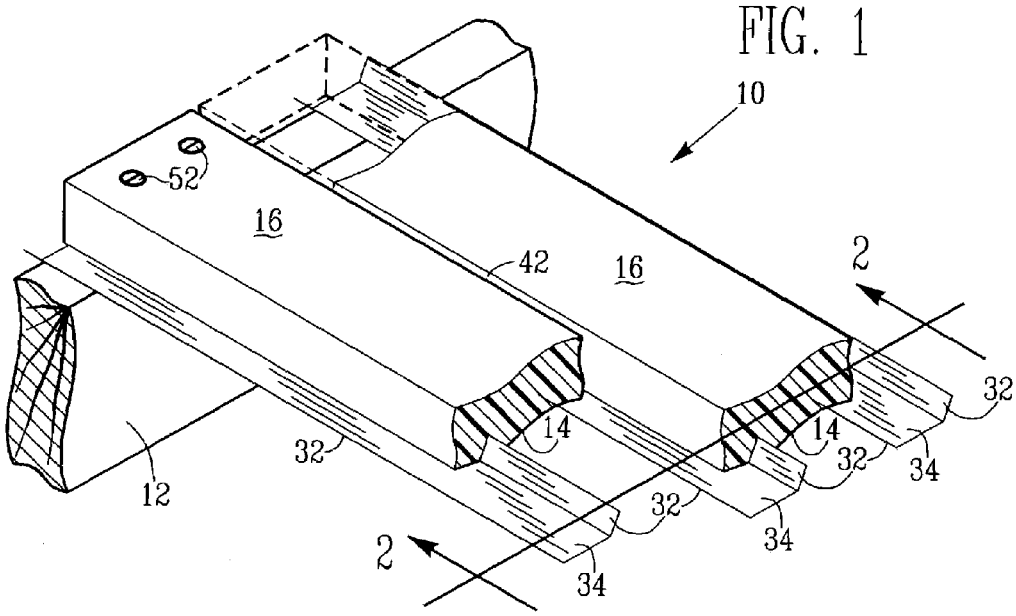
FIG. 1 is a perspective view depicting a preferred embodiment gutter system in accordance with the present invention in which channels are integrated with the deck's planks.
Figure 2:
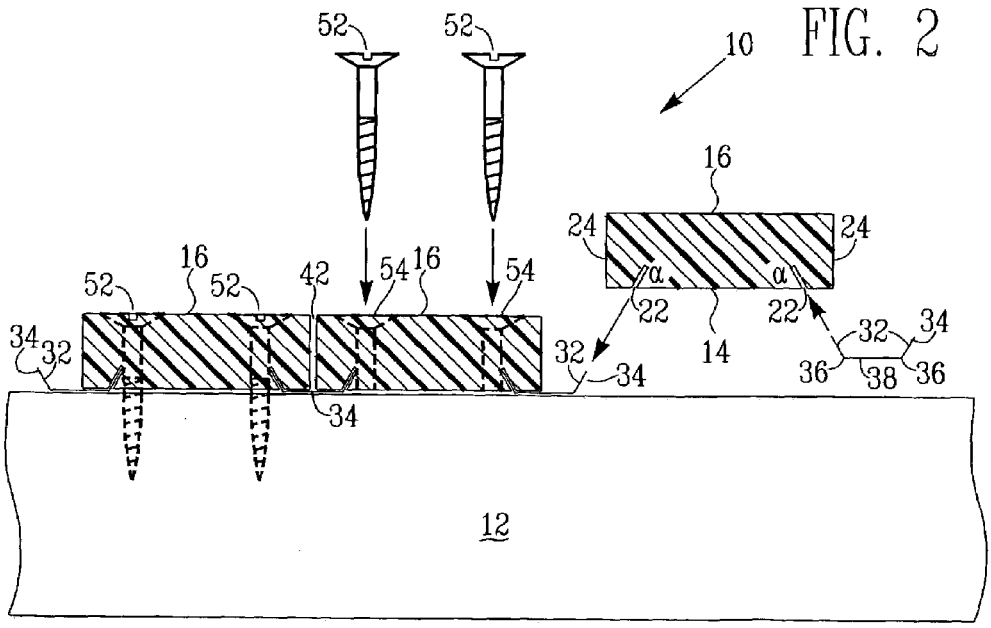
FIG. 2 is a cross-sectional elevational view of the integrated gutter system taken along the line 2—2 in FIG. 1.
Figure 3:
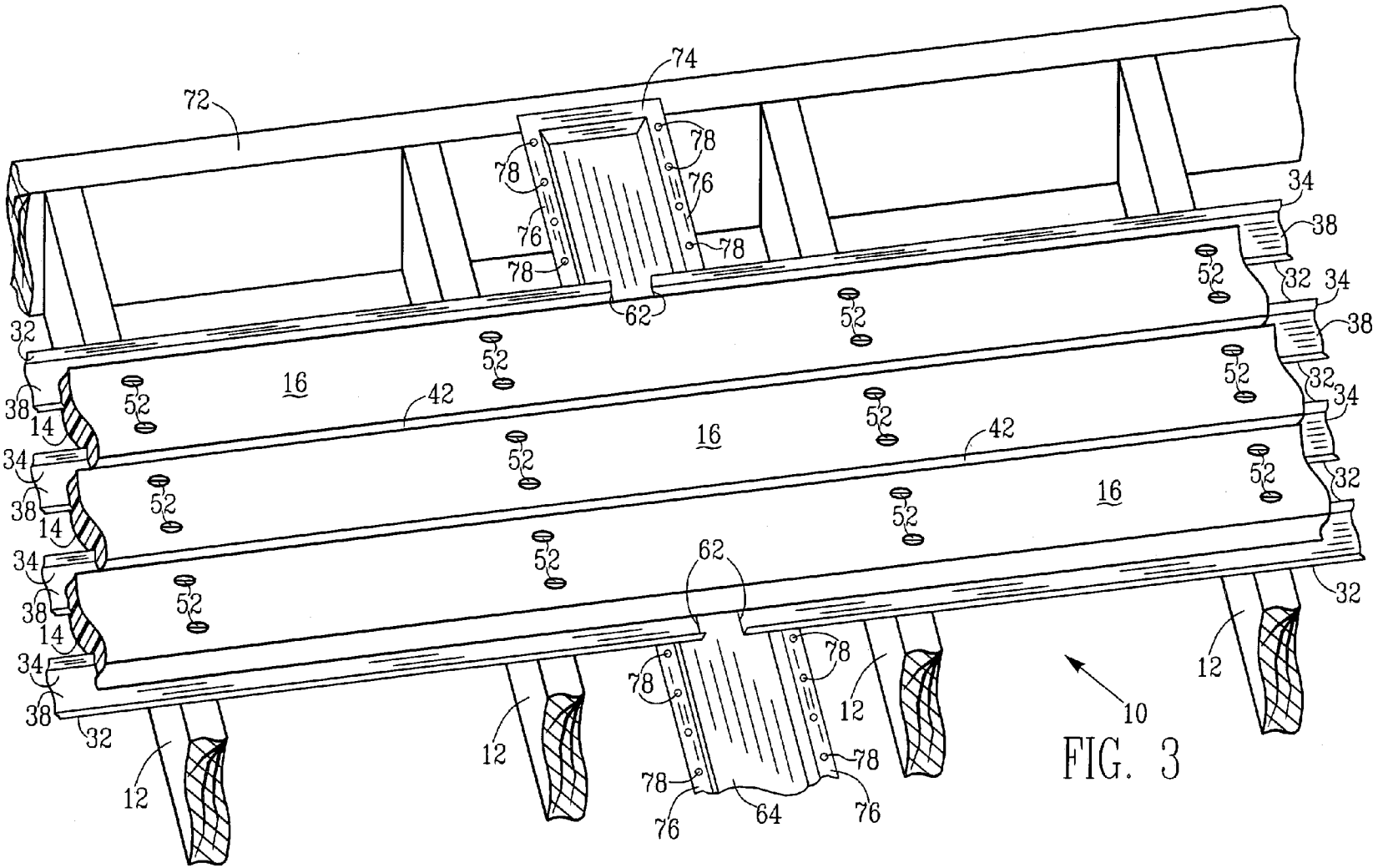
FIG. 3 is a perspective view of the integrated gutter system of FIG. 1 that also includes a collection gutter.

FIGS. 1 through 3 depict a deck in accordance with the present invention identified by the general reference number 10. The deck 10 includes several, preferably wooden, joists 12 that are separated from each other and that are fixed with respect to each other. As depicted in FIGS. 1 through 3, undersurfaces 14 of a number of planks 16, collectively disposed in a substantially parallel orientation, are juxtaposed with the joists 12.

If the deck 10 is elevated and abuts a building, not illustrated in any of the FIGS., the joists 12 are preferably oriented parallel to the building so the planks 16 supported by the joists 12 are oriented substantially perpendicularly to the building. In such circumstances, the joists 12 are preferably supported by beams, not illustrated in any of the FIGS., that are anchored perpendicularly to the building, and that are supported by posts near exposed ends of the beams.

Before planks 16 are juxtaposed with the joists 12, two (2) longitudinal slices 22 are cut into the undersurface 14 of each plank 16. Each slice 22 preferably pierces the undersurface 14 at a distance of less than one-half (½) inch from a side-surface 24 of the plank 16. Each slice 22 is preferably oriented inward toward the center of the plank 16 with respect to the undersurface 14 at an acute angle of 600 indicated in FIG. 2 by the Greek letter $\alpha$. After the slices 22 have been cut in the undersurface 14 the plank 16 and during juxtaposition of the plank 16 with the joists 12, a substantially planar flange 32 of an elongated, one-piece channel 34 is inserted into each of the slices 22.

As depicted in FIGS. 1 through 3, each one-piece channel 34 includes two (2) substantially planar flanges 32 which respectively extend along opposite edges 36 of a substantially planar central section 38 of the channel 34, and are not coplanar therewith. The central section 38 shares each edge 36 with one of the flanges 32 of which it also forms an edge 36. The central section 38 preferably has a width between the edges 36 of approximately one (1) inch so both of the flanges 32 may be fully inserted into the slices 22 cut into two (2) immediately adjacent planks 16. The portion of the flanges 32 extending away from the central section 38 of each channel 34 are preferably formed to diverge from each other at an acute angle of 60° if the planes of both flanges 32 were extended past the central section 38 to a line along which they intersect each other. Consequently, after one of the flanges 32 of a channel 34 is fully inserted into the slice 22 cut into the undersurface 14 of a plank 16, the central section 38 of the channel 34 is oriented substantially parallel to, but not coplanar with, the undersurface 14 of the plank 16. In this way, each channel 34, which is preferably made from medium-weight galvanized sheet metal, spans between the two (2) immediately adjacent planks 16 to provide, in conjunction with the two (2) planks 16, an impervious gutter 42 for that portion of the deck 10. Other suitable sheet materials from which the channels 34 may be formed include stainless steel, aluminum or polycarbonate plastic.

The preferred material for the planks 16 is a solid plastic wood-alternative material sold by a number of different manufacturers that is made from 100% recycled polyethylene plastic obtained from soda bottles, detergent bottles, and milk containers. This solid plastic wood-alternative material is strong, impact resistant, and "wood-like" in appearance. Furthermore, this material is maintenance free, and safe to walk on wet or dry. Similar to wood, the solid plastic wood-alternative material can be cut, drilled, mitered, and sanded with conventional woodworking tools. For best results, the solid plastic wood-alternative material is cut with a carbide tip, teflon® coated circular saw blade with a thick kerf design and ribbed heat vents to obtain a smooth cut and reduce the tendency for the blade to "grab" in the material. A suitable standard saw blade is available from most building supply centers.

Various conventional fasteners may be used for securing the solid plastic wood-alternative material of the planks 16 to the joists 12. However, as depicted particularly in FIG. 2, to withstand expansion and contraction of the planks 16 as well as maintaining a long lasting, beautiful looking deck 10, stainless steel deck fasteners 52 are preferably used for securing the planks 16 to the joists 12. For planks 16 that are nominally two (2) inches thick, i.e. actual measured thickness being one and one-half (1½) inches, stainless steel square head #10 deck fasteners 52 two and one-half (2½) or three (3) inches long are preferred for the fasteners 52. Preferably, holes 54 to receive the fasteners 52 are predrilled and counter-sunk into the solid plastic wood-alternative material planks 16, particularly if screws used for the fasteners 52 are not self-tapping. If holes 54 are not predrilled into the planks 16, due to friction heating of the plank 16 during screwing to the joist 12, from time to time pigtails of the solid plastic wood-alternative material may occur as well as broken screws. All fasteners 52 should be placed no closer than one (1) inch from any edge of the solid plastic wood-alternative material planks 16, nor protrude from any plank 16 closer than one (1) inch from any edge.

Solid plastic wood-alternative materials made from recycled plastic expand and contract in response to changes in temperature. For example, a twelve (12) foot plank 16 may expand or contract one-quarter (¼) inch in response to a 40° degree Fahrenheit change in temperature. Consequently, when a plank 16 abuts against any wall, fixed surface or other board, it should be securely fastened to the nailer or double joist with a gap allowing for expansion. The size of gap should be determined based on weather conditions at the time of installation. The closer the temperature is to th usual high temperature for the year, the smaller the gap.

The planks 16 of the deck 10 should be arranged to minimize the butt joints between planks 16. However, if joints are required, a double joist should be used beneath the butt joint. The planks 16 on both sides of the joint should be securely fastened with a row of fasteners 52 on each side of the joint. Always space planks 16 three-eights (⅜) inch from a permanent structure. Lighter color planks 16 do not heat up as much in sunlight and are therefore preferable if the deck 10 is in a very sunny location.

A short time interval after assembly of the planks 16, the slices 22 clamp the flanges 32 firmly within the solid plastic wood-alternative material so the gutters 42 do not leak. Clamping of the flanges 32 by the slices 22 occurs due to a difference in tension between the outer "skin" of the solid plastic wood-alternative material planks 16 and material in the interior of the plank 16. With the plank 16 thus sealed to the channels 34, the gutters 42 carry runoff water between normally spaced pairs of planks 16 to the end of the channels 34. The deck 10 need not be sloped, but the planks 16 cannot sag more than ¾ inch below their highest point. To prevent sagging and to accommodate the properties of the solid plastic wood-alternative material, for planks 16 that are nominally two (2) inches thick, i.e. actual measured thickness being one and one-half (1½) inches, the joists 12 should be spaced no further than sixteen (16) inches apart center to center. By sloping the planks 16 one-eighth (⅛) inch per foot downward away from a wall of a building, the gutters 42 drain water away from the wall to an edge of the deck 10.

If the edge of the deck 10 is further from the wall of a building than the length of the channels 34, then ends of pairs of channels 34 may be overlapped to establish gutters 42 which extend from the wall to the edge of the deck 10. Securing the planks 16 to the joists 12 combined with the firm clamping of overlapped slices 22 within the solid plastic wood-alternative material produces a seal between the channels 34 so the gutters 42 do not leak.

FIG. 3 depicts a configuration for the gutters 42 in which all the runoff water does not drain to an edge of the deck 10. Rather, in the illustration of FIG. 3 the channels 34 include ends 62 that are located in the interior of the deck 10. For this configuration of the deck 10, some of the runoff water drains from the gutters 42 into an elongated, trough-shaped collection gutter 64 formed from medium-weight galvanized sheet metal that is disposed beneath the ends 62 of the channels 34. The collection gutter 64 is located between and oriented parallel to the joists 12 supporting the planks 16. Ends of the joist 12 are fixed to a ledger 72 that is secured to a wall of a building not illustrated in FIG. 3. An end flange 74 of the collection gutter 64 rests on the ledger 72 thereby supporting that end of the collection gutter 64. A pair of longitudinal flanges 76 extend along opposite sides of the collection gutter 64 which increases its rigidity.

The collection gutter 64 may be fastened to undersurfaces 14 of the planks 16 with pan-head, non-corrosive screws, not illustrated in any of the FIGS., disposed through holes 78 that pierce the longitudinal flanges 76. Alternatively, the collection gutter 64 may be held tightly up against undersurfaces 14 of the planks 16 with blocking, not illustrated in any of the FIGS., that is secured immediately beneath the collection gutter 64 and between an immediately adjacent pair of joists 12 which are located on opposite sides of the collection gutter 64.

Figure 4:
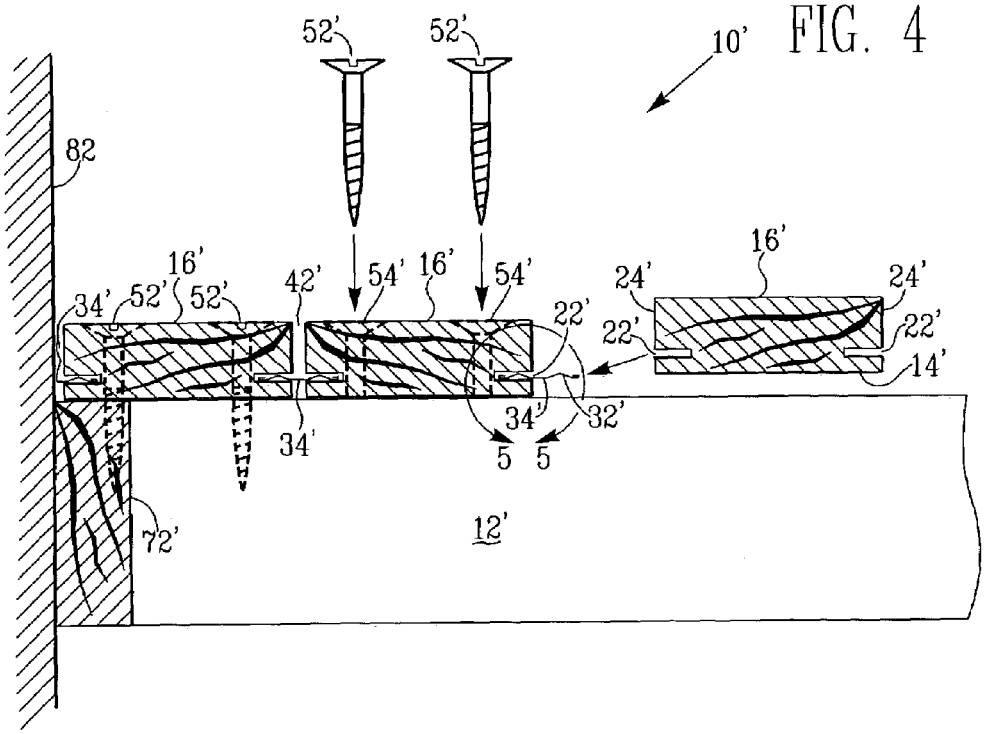
FIG. 4 is a cross-sectional elevational view depicting an alternative embodiment gutter system in accordance with the present invention in which channels are integrated with the deck's planks.
Figure 5:
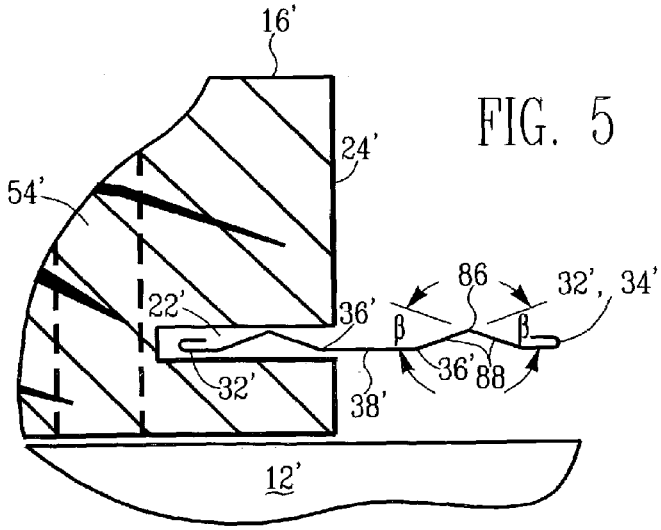
FIG. 5 is a cross-sectional elevational view of the alternative embodiment integrated gutter system taken along the line 5—5 in FIG. 4.

FIGS. 4 and 5 illustrate an alternative embodiment, integrated gutter system in accordance with the present invention. Those elements depicted in FIGS. 4 and 5 that are common to the integrated gutter system illustrated in FIGS. 1–3 carry the same reference numeral distinguished by a prime ("") designation. For the deck 10' illustrated in FIG. 4, joists 12' are fixed to a ledger 72' that is fastened to a wall 82 of a building. Assembled in substantially the same way as the deck 10 illustrated in FIGS. 1–3, solid wood planks 16' of the deck 10' are secured to the joists 12' by fasteners 52' which extend through holes 54' which are drilled through the planks 16'. For the alternative embodiment deck 10' illustrated in FIGS. 4 and 5, plated threaded half-shank #10 screws three (3) inches long are preferred for the fasteners 52'.

In the embodiment depicted in FIGS. 4 and 5, slices 22' are preferably cut three thirty-seconds (3/32) of an inch wide and one (1.0) inch deep into side-surfaces 24' of solid wood planks 16' approximately one-half (½) inch above undersurfaces 14' thereof. Referring now particularly to FIG. 5, each slice 22' receives one of the flanges 32' of the channel 34' that respectively extend longitudinally along both edges 36' of the central section 38' thereof. The sheet material of each flange 32', from which the channel 34' is formed, includes an upwardly projecting, inverted, V-shaped ridge 86 that extends longitudinally along the flange 32' parallel to the central section 38' of the channel 34'. Sides 88 of the V-shaped ridges 86 are respectively oriented at an angle β with respect to the substantially planar central section 38' of the channel 34'. The angle β is preferably twenty degrees (20°).

Similar to the channels 34 illustrated in FIGS. 1–3, the channels 34' are preferably made from medium-weight galvanized sheet metal, and span between the two (2) immediately adjacent planks 16' to provide, in conjunction with the two (2) planks 16', impervious gutters 42' that are located between the two (2) planks 16'. At the wall 82, the central section 38' of the channel 34' bends upward at a right angle, i.e. ninety degrees (90°), and the flange 32', which extends outward from the slice 22, presses against the wall 82 to provide the impervious gutter 42'. Swelling of the wooden planks 16' due to the presence of runoff water in gutters 42' causes the flanges 32' to be squeezed and sealed within the slices 22' cut into side-surfaces 24' of the planks 16'. Other suitable sheet materials from which the channels 34' may be formed include stainless steel, aluminum or polycarbonate plastic.

Figure 6:
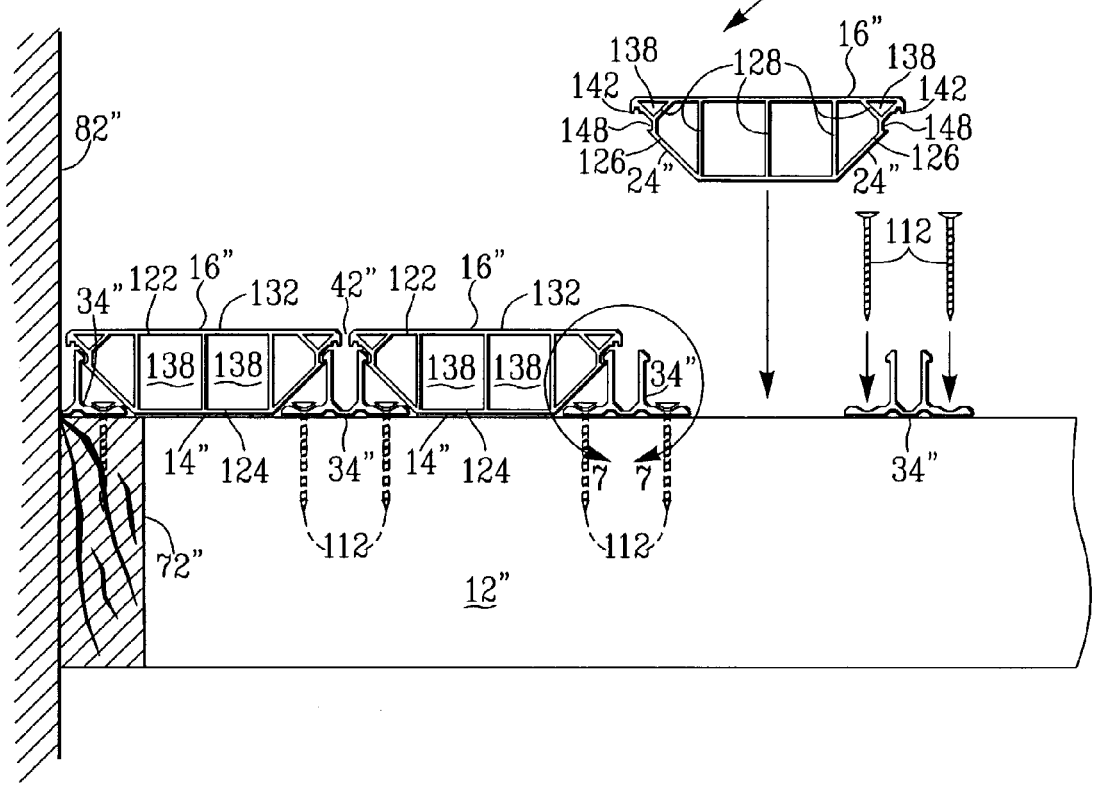
FIG. 6 is a cross-sectional elevational view depicting yet another alternative embodiment gutter system in accordance with the present invention in which channels are integrated with the deck's planks.
Figure 7:
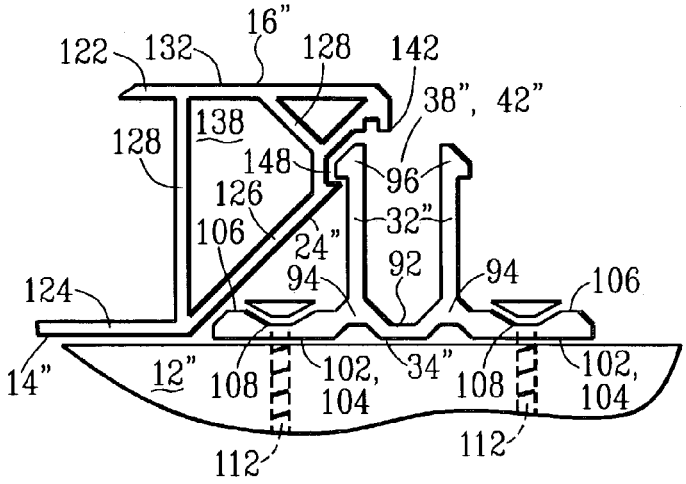
FIG. 7 is a cross-sectional elevational view of the alternative embodiment integrated gutter system taken along the line 7—7 in FIG. 6.

FIGS. 6 and 7 illustrate yet another alternative embodiment integrated gutter system in accordance with the present invention. Those elements depicted in FIGS. 6 and 7 that are common to the integrated gutter systems respectively illustrated in FIGS. 1—3 and in FIGS. 4 and 5 carry the same reference numeral distinguished by a double prime ("") designation. The integrated gutter system illustrated in FIGS. 6 and 7 is adapted for a deck 10" built with hollow, extruded planks 16". Referring now particularly to FIG. 7, the channels 34" for the embodiment of the integrated gutter system illustrated in FIGS. 6 and 7 each include a U-shaped central section 38" which provides the impervious gutter 42". The central section 38" of each channel 34" includes a base 92 that at least a portion of which is adapted to be juxtaposed with and rest upon joists 12". The central section 38" also includes a pair of flanges 32" that project upward from opposite edges 94 of the base 92, each of which flanges 32" terminates in a barbed peak 96. A pair of channel mounting-strips 102 respectively extend along and project horizontally outward from the opposite edges 94 of the base 92 of the U-shaped central section 38". A lower surface 104 of each channel mounting-strip 102 is juxtaposed with and rests upon the joists 12". An upper surface 106 of each channel mounting-strip 102 has a longitudinal groove 108 formed therealong that is pierced by fasteners 112 for securing the channel 34" to the joist 12". For the alternative embodiment deck 10" illustrated in FIGS. 6 and 7, the preferred fasteners 112 are self-tapping, flat-head #10 screws one and one half (1½) inches long.

Each of the hollow planks 16" includes a horizontal upper wall 122, a horizontal lower wall 124, and side walls 126 which preferably slope at an angle of forty-five degrees (45°) with respect to the walls 121 and 124. Each plank 16" also includes several ribs 128 having varying orientations with respect to and which extend between the upper wall 122 and either the lower wall 124 or one of the side walls 126 along lengths thereof. The lower wall 124 provides the undersurface 14" of the plank 16", the upper wall 122 provides an upper surface 132, and the side walls 126 provide side-surfaces 24" thereof. The two side-surfaces 24" are separated by and abut opposite edges both of the upper surface 132 and of the undersurface 14" of the plank 16". The ribs 128 together with portions of the upper wall 122, the lower wall 124 and/or the side walls 126 enclose hollow chambers 138 that extend along and within the plank 16". An upper end of each of the side walls 126 of the plank 16" includes a drip lip 142 which extends over the gutter 42" provided by channels 34". Runoff water draining from the upper surface 132 of the plank 16" past the drip lip 142 falls directly into the gutter 42".

Each side wall 126 of the plank 16" is formed to include a barbed, longitudinal groove 148. During assembly of the deck 10" illustrated in FIG. 6, two channels 34", separated by a pre-established distance across, the joists 12", are secured thereto by fasteners 112. The pre-established distance between each pair of channels 34" may be easily established by cutting a two (2) inch length off the but end of a plank 16" and using it to gauge the spacing between immediately adjacent pairs of channels 34".

As depicted in FIG. 6, if the channel 34" is immediately adjacent to the wall 82", then only one-half (½) of a channel 34" having only one flange 32" is secured to the joists 12". After a pair of channels 34" have been secured to the joist 12", the plank 16" is lowered toward the channels 34" until the barbed grooves 148 on each side wall 126 of the plank 16" mate and lock with the barbed peaks 96 of flanges 32" respectively of each of the channels 34". In this way the channels 34" secure the plank 16" to the joist 12".

Both the planks 16" and the channels 34" are preferably extruded from polyvinyl chloride ("PVC"). Alternatively, the planks 16" and the channels 34" may be made from a material which has the requisite durability, strength, and flexibility characteristics necessary for the planks 16" and the channels 34". Thus the planks 16" and the channels 34" may be extruded from any other suitable thermoplastic material such as polypropylene, polyethylene, high density polyethylene ("HDPE"), vinyl acetate copolymers, vinyl chloride monomers ("VCM"), or acrylonitrile-butadiene-styrene ("ABS").

Although the present inventions have been described in terms of the presently preferred and various alternative embodiments, it is to be understood that such disclosure is purely illustrative and is not to be interpreted as limiting. For example, one may envision various alternative ways in which runoff water may be collected from ends 62 of the channels 34 in addition to the collection gutter 64 depicted in FIG. 3. Consequently, without departing from the spirit and scope of the inventions, various alterations, modifications, and/or alternative applications thereof will, no doubt, be suggested to those skilled in the art after having read the preceding disclosure. Accordingly, it is intended that the following claims be interpreted as encompassing all alterations, modifications, or alternative applications as fall within the true spirit and scope of the inventions.

What is claimed is:

1. A unitary channel adapted for integration with adjacent solid planks of a deck for providing a gutter therebetween, each plank being disposible above at least one joist;

being securable to at least one joist; and having an undersurface which is juxtaposable with at least one joist; the channel comprising a pair of flanges each of which is receivable into and mateable with a longitudinal slice respectively formed into undersurfaces of adjacent planks, a central section of the channel with the flanges respectively extending along opposite edges thereof being disposible upon the joist; and when the central section rests on the joist, each flange extending upward from the central section;

whereby, upon the flanges becoming respectively disposed within slices respectively formed into undersurfaces of adjacent planks and when the central section of the channel and planks rest upon a joist, the channel spans between adjacent planks thereby providing an impervious gutter that a. extends between and along adjacent planks; and b. above at least one joist that is adapted for supporting planks.

2. The channel of claim 1 wherein the channel is formed from an elongated piece of sheet material.

3. The channel of claim 2 wherein the sheet material of the channel is selected from a group that consists of galvanized sheet metal, stainless steel, aluminum and polycarbonate plastic.

4. The channel of claim 1 wherein the flanges extending away from opposite edges of the central section of the channel diverge.

5. A unitary channel adapted for integration with adjacent planks of a deck for providing a gutter therebetween, each plank being disposible above at least one joist;

being securable to at least one joist;

having an undersurface which is juxtaposable with at least one joist; and having longitudinal grooves formed along side surfaces thereof;

the channel comprising a pair of flanges each of which is receivable into and mateable longitudinal grooves formed along side surfaces of adjacent planks; and the channel including both a. a U-shaped central section which provides the gutter, and which includes both i. a base that is juxtaposable with and disposible upon at least one joist; and ii. the flanges that project upward from opposite edges of the base, each flange having a peak that is shaped for mating and locking with longitudinal grooves formed along side surface of adjacent planks; and b. a pair of channel mounting-strips which respectively i. extend along and project horizontally outward from the opposite edges of the base of the U-shaped central section; and ii. are A. juxtaposable with and disposible upon at least one joist; and B. pierceable by a fastener for securing the channel to at least one joist;

thereby forming an impervious gutter that a. extends between and along adjacent planks; and b. above at least one joist that is adapted for supporting planks.

6. The channel of claim 5 wherein an upper surface each channel mounting-strip distal from a joist has a longitudinal groove therealong that is pierceable by a fastener for securing the channel to at least one joist.

7. The channel of claim 5 wherein the channel is formed from a material that is selected from a group that consists of polyvinyl chloride ("PVC"), polypropylene, polyethylene, high density polyethylene ("HDPE"), vinyl acetate copolymers, vinyl chloride monomers ("VCM") , and acrylonitrile-butadiene-styrene ("ABS").

* * * * *